US009630688B2

(12) United States Patent
Goode

(10) Patent No.: US 9,630,688 B2
(45) Date of Patent: Apr. 25, 2017

(54) LATERAL OR TRANSVERSE FLEX SPORTS BOARD

(71) Applicant: Carbon Innovation, Inc., Ogden, UT (US)

(72) Inventor: David P Goode, Huntsville, UT (US)

(73) Assignee: Carbon Innovation, Inc., Ogden, UT (US)

( * ) Notice: Subject to any disclaimer, the term of this patent is extended or adjusted under 35 U.S.C. 154(b) by 0 days.

(21) Appl. No.: 14/828,187

(22) Filed: Aug. 17, 2015

(65) Prior Publication Data

US 2016/0251063 A1 Sep. 1, 2016

Related U.S. Application Data

(60) Provisional application No. 62/126,357, filed on Feb. 27, 2015.

(51) Int. Cl.
*B63B 35/81* (2006.01)
*A63C 5/03* (2006.01)
*B63B 35/79* (2006.01)

(52) U.S. Cl.
CPC ..... *B63B 35/7906* (2013.01); *B63B 35/7926* (2013.01)

(58) Field of Classification Search
CPC . B63B 35/79; B63B 35/7906; B63B 35/7926; B63B 2035/79; B63B 2035/7903
USPC ..... 441/65, 74; 114/39.12, 39.14
See application file for complete search history.

(56) References Cited

U.S. PATENT DOCUMENTS 4,129,911 A * 12/1978 McDonald ..... B63B 35/7906 441/74
4,876,806 A * 10/1989 Robinson ..... A43B 5/00 36/114
2010/0240271 A1* 9/2010 Mann ..... B63B 35/7906 441/74

FOREIGN PATENT DOCUMENTS

FR 2698794 A1 * 6/1994 ..... A63C 5/12

* cited by examiner

*Primary Examiner* — Daniel V Venne
(74) *Attorney, Agent, or Firm* — Kunzler Law Group

(57) ABSTRACT

A lateral flex sports board includes an elongated load supporting board having a top major surface, the top major surface configured to support a user, wherein the elongated load supporting board includes a portion that flexes transversely to the top major surface.

19 Claims, 10 Drawing Sheets

LATERAL OR TRANSVERSE FLEX SPORTS BOARD

CROSS-REFERENCE TO RELATED APPLICATIONS

This application claims the benefit of U.S. Provisional Application No. 62/126,357, filed on Feb. 27, 2015, which is incorporated by reference herein in its entirety.

BACKGROUND

Sports boards, such as water skis, have evolved over time in the manner of their construction and operation. Using a water ski as an example, water skis were originally designed from a solid piece of wood. In the early 1970's wood was replaced with a combination of a core (typically a foam core, or a honeycomb core, etc.) and a fiber reinforced covering around the core. This design provided a lighter weight alternative to wood. Such water skis only allow for a longitudinal flex and/or torsional flex, while restricting a lateral flex.

SUMMARY

Embodiments of a lateral flex sports board are described. In one embodiment, a lateral flex sports board includes an elongated load supporting board having a top major surface, the top major surface configured to support a user, wherein the elongated load supporting board includes a portion that flexes transversely to the top major surface. Other embodiments of lateral flex sports boards are described. Embodiments of lateral flex water sports boards are also described.

Other aspects and advantages of embodiments of the present invention will become apparent from the following detailed description, taken in conjunction with the accompanying drawings illustrated by way of example of the principles of the invention.

Figure 1A:
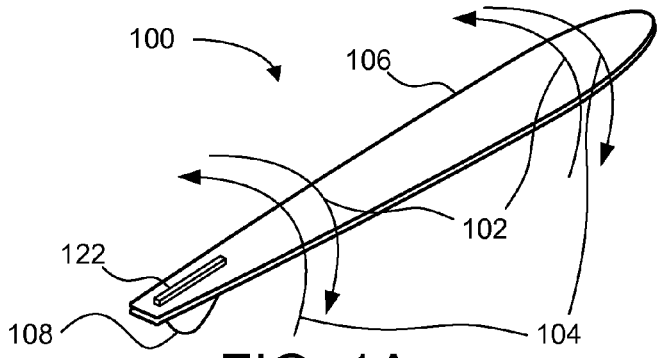
FIG. 1A depicts a perspective view of a water ski showing the direction of a torsional flex on the water ski.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

It will be readily understood that the components of the embodiments as generally described herein and illustrated could be arranged and designed in a wide variety of different configurations. Thus, the following description of various embodiments, and as represented in the figures, is not intended to limit the scope of the present disclosure, but is merely representative of various embodiments.

The present invention may be embodied in other specific forms without departing from its spirit or essential characteristics. The described embodiments are to be considered in all respects only as illustrative and not restrictive. All changes which come within the meaning and range of equivalency of the description and claims are to be embraced within their scope.

Reference throughout to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

FIG. 1A depicts a perspective view of a water ski 100 showing the direction of a torsional flex 102-104 on the water ski 100. A water ski is subject to many forces during use. Those forces may cause the water ski 100 to flex. The shape of water skis allow for flexing torsionally (directionally shown in FIG. 1A) and longitudinally (directionally shown in FIG. 1B). Depicted in FIG. 1A is a torsional flex in which the rotation of the tip portion of the ski is directed opposite to the rotation on the tail portion of the ski. This is depicted as torsional flex 102, in which the tip portion rotates counter clockwise, opposite the rotational direction from the tail portion of the ski which rotates clockwise. Torsional flex 104 depicts a torsional flex in the opposite directions of torsional flex 102. The water ski 100 depicts a board 106, a fin 108, and a fin box 122.

Figure 1B:
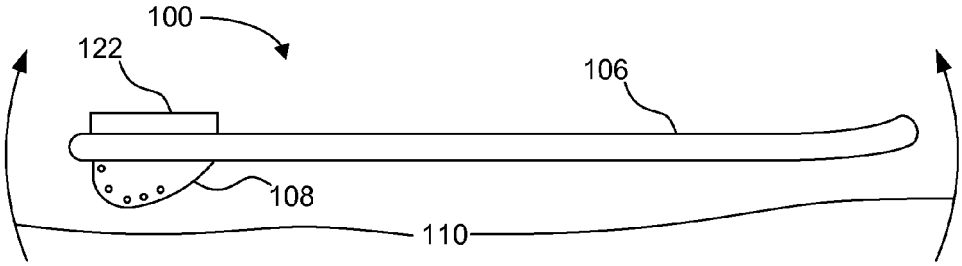
FIG. 1B depicts a side view of the water ski of FIG. 1A showing the direction of a longitudinal flex on the water ski.

FIG. 1B depicts a side view of the water ski of FIG. 1A showing the direction of a longitudinal flex 110 on the water ski 100. This longitudinal flex typically occurs as the tip and tail portions of the water ski 100 flex up while the middle portion is forced down from the weight of a user.

Figure 1C:
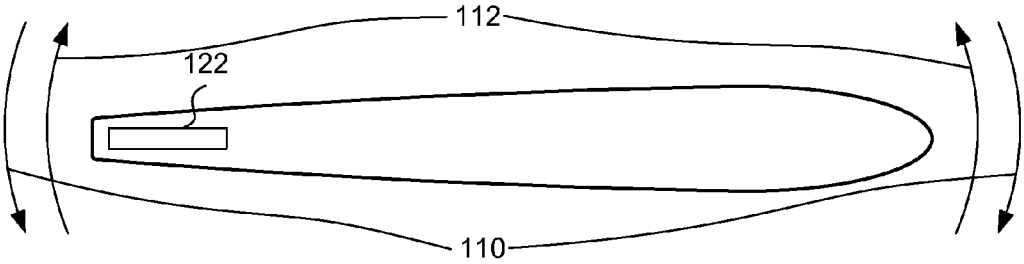
FIG. 1C depicts a top view of the water ski of FIG. 1A.

FIG. 1C depicts a top view of the water ski of FIG. 1A. Water skis are not designed to flex laterally. The direction of a left lateral flex 112 and a right lateral flex 114 are depicted by the arrows shown in FIG. 1A. A lateral flex occurs, for example, when the tip and tail portions of the water ski flex opposite of the middle section. Water skis are rigid in the lateral direction, and do not flex in the directions shown in FIG. 1C. Such rigidity occurs naturally because of the shape of the sports board. Such lateral rigidity is also the case for snowboards, snow skis, surfboards, wakeboards, and other similarly shaped sports boards.

Figure 1D:
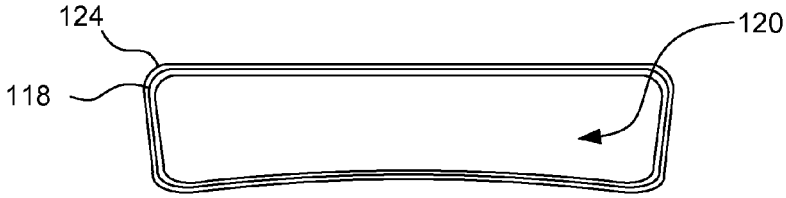
FIG. 1D depicts a cross-sectional view of a cut-away of the board of FIG. 1C.

FIG. 1D depicts a cross-sectional view of a cut-away of the board 106 of FIG. 1C. The board 106 may include fiber layers 118 (for example, carbon fiber materials) wrapped around a core 120 (multiple fiber layers 118 are not depicted). The board 106 may include a coating layer 124. The fiber layers 118 may be arrayed in various configurations to achieve optimum longitudinal flex while maintaining an acceptable amount of torsional stiffness. The cross-sectional shape of the board 106 restricts lateral flex as the board 106 with corresponding core 120 is typically much wider (the horizontal dimension) than it is thick (the vertical dimension).

While many embodiments are described herein, at least some of the described embodiments allow for a lateral flex in a sports board. Embodiments allow for improved performance in sports with an increased ability to turn with less energy loss. The decrease in lost energy allows for more kinetic energy or speed on turns. Embodiments allow for manufacturing boards to achieve optimal lateral flex in the board, while maintaining torsional strength and longitudinal strength.

For the sake of brevity the majority of embodiments and discussion surrounds water skis. However, the described features, advantages, and characteristics of the invention may be combined in any suitable manner in one or more embodiments and may be used on various sports boards including but not limited to snow skis, snowboards, wakeboards, surfboards, and other similar sports boards. One skilled in the relevant art will recognize, in light of the description herein, that the invention can be practiced on more than the specific water ski embodiments described herein. Some embodiments are limited to water sports boards which include water skis, surfboards, and wakeboards.

Continuing the example of a water ski, water skis typically include a fixed fin at the rear of the water ski. The fins are fixed and do not move relative to the board. Fins (and wings on the fins) are adjusted to meet the needs of individual skiers, taking into account an individual's skiing style and weight, as well as boat speed. Adjustments of even a few thousands of an inch may make large differences in performance. As the fins are fixed, when a water skier attempts to turn the board of a water ski, the fin will move with the board. As the skier turns the board, the angle at which the fin contacts water below the board, shearing the water and creating a spray as the fin displaces the water. The angle at which the fin contacts the water is dependent upon how much the skier turns the board because the fin is fixed to the board and typical water skis will not flex laterally. However, embodiments described herein allow for the board to flex laterally and change the angle at which the fin contacts the water on a turn. With a lateral flex sports board, as a skier turns in the water the forces from the water acting on the fin will resist the turn of the board by the skier. As the lateral flex sports board flexes laterally, the angle at which the fin contacts the water will decrease and thus decrease the amount of shearing of the water and the amount of spray. Such reduction in lost energy results in a skier performing a turn at a higher speed while still maintaining control. The reduction in energy transferred to the spraying water is conserved and available for kinetic energy, allowing skiers to increase the speed of turns.

Figure 2A:
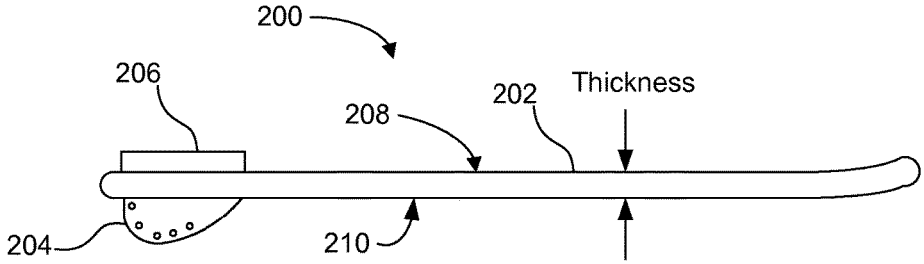
FIG. 2A depicts an embodiment of a side view of a lateral flex sports board.
Figure 2B:
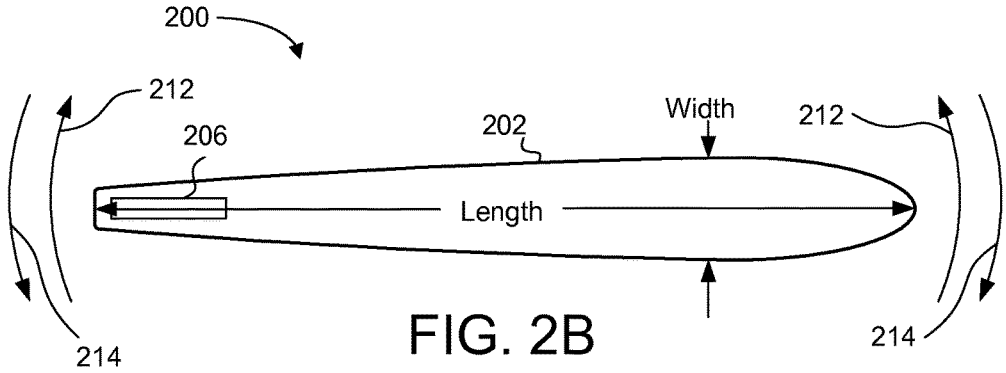
FIG. 2B depicts an embodiment of a top view of a lateral flex sports board showing the direction of a lateral flex.
Figure 2C:
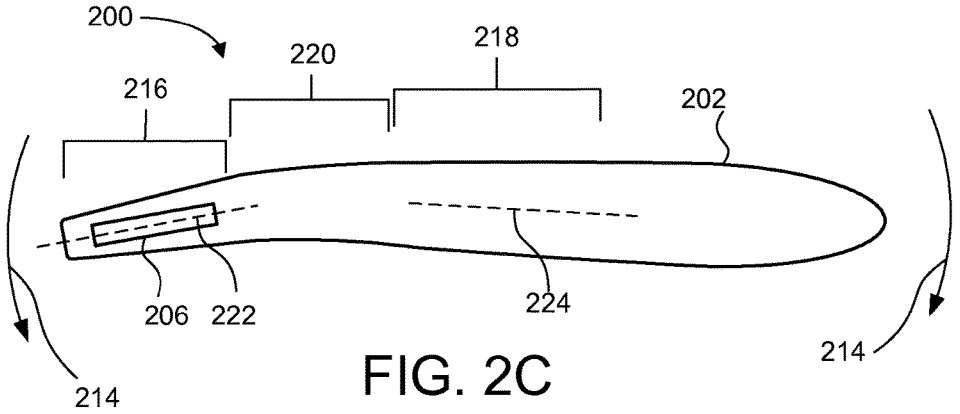
FIG. 2C depicts an embodiment of a top view of a lateral flex sports board showing the board in flexed position.

FIGS. 2A-2C depict embodiments of a lateral flex sports board 200. FIG. 2A depicts an embodiment of a side view of a lateral flex sports board 200. The lateral flex sports board 200 includes an elongated load supporting board 202 along with a fin 204 and a fin box 206. The illustrated embodiment shows the thickness of the elongated load supporting board 202. The thickness of the elongated load supporting board 202 is a vertical dimension from the top major surface 208 which supports a user to the bottom major surface 210. The thickness of the load supporting board 202 may vary along the length of the load supporting board 202. The thickness of the load supporting board 202 may also vary along the width of the load supporting board 202. That is, the thickness of the load supporting board may be greater near the sides of the board as opposed to the center of the load supporting board 202.

FIG. 2B depicts an embodiment of a top view of a sports board 200 showing the direction of a left lateral flex 212 and a right lateral flex 214. The general natural shape of a sports board is shown. While the width of the elongated load supporting board 202 may vary along the length of the board (as shown), the elongated load supporting board 202 has a width greater than the thickness. This is necessary so that a user may balance on the board. This shape naturally resists lateral movement in favor or longitudinal movement. As depicted the axis of the fin box 206 (and corresponding fin, not visible) aligns with the axis of the elongated load supporting board 202.

FIG. 2C depicts an embodiment of a top view of the lateral flex sports board 200 of FIG. 2B, showing the board in the laterally flexed position of a right lateral flex 214. In some embodiments, the lateral flex occurs at a localized point on the load supporting board 202. In some embodiments, the lateral flex occurs along a length of the load supporting board 202. In some embodiments, the lateral flex occurs along the length of load supporting board 202 in between a tail portion 216 (including the fin and fin box 206) of the board 200 and a foothold support portion 218 of the board 200. The length upon which the lateral flex occurs is the flexing portion 220 of the board 200. As the board flexes laterally, the axis (shown by dotted line 222) of the fin box 206 (and corresponding fin, not visible) is no longer aligned with the axis (shown by dotted line 224) of the foothold portion. This means that when a skier is performing a turn, the skier will exert a force upon the load supporting board 202 at the foothold support portion 218 and the water will exert a force upon the fin, but the opposing force of the water on the fin will cause the board to flex laterally and the fin will more closely follow the turn of the board. In some embodiments, the flexing portion 220 of the board 200 may overlap into the foothold portion 218 of the board 200. The amount of lateral flex may vary. In some embodiments, during a lateral flex, the angle between the fin box axis 222 of the fin box and the foothold axis 224 is 0.1 degrees. In some embodiments, during a lateral flex, the angle between the fin box axis 222 of the fin box and the foothold axis 224 is greater than 0.1 degrees. In some embodiments, during a lateral flex, the angle between the fin box axis 222 of the fin box and the foothold axis 224 is greater than 0.2 degrees. In some embodiments, during a lateral flex, the angle between the fin box axis 222 of the fin box and the foothold axis 224 is greater than 0.5 degrees. In some embodiments, during a lateral flex, the angle between the fin box axis 222 of the fin box and the foothold axis 224 flexes from 0 to 1 degrees.

Figure 3A:
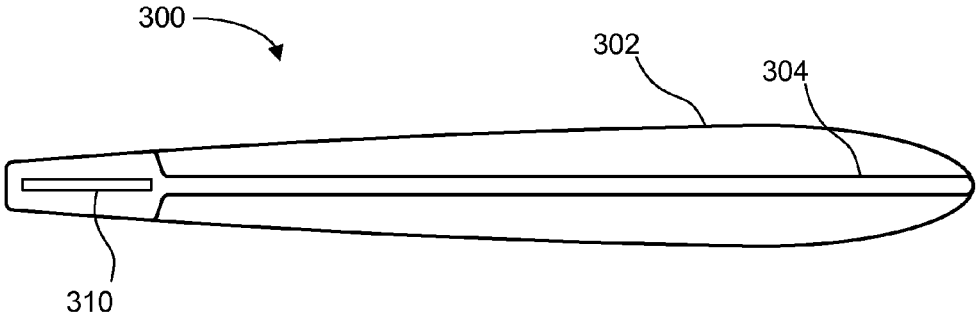
FIG. 3A depicts one embodiment of a sports board 300 that allows for lateral flex.
Figure 3B:
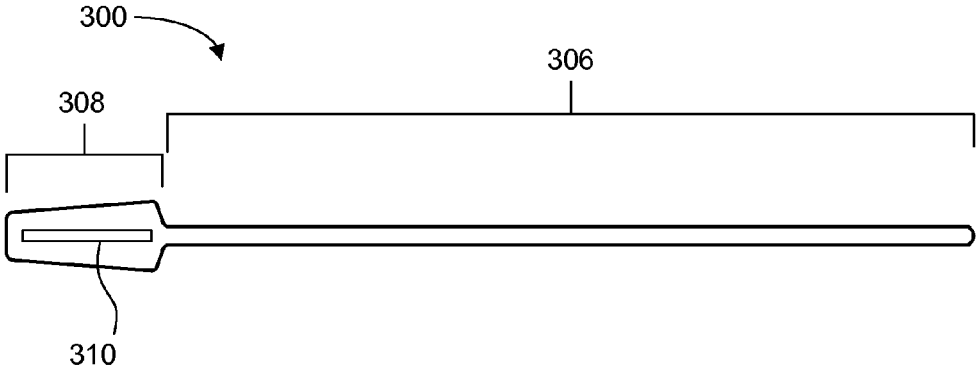
FIG. 3B depicts a top view of an embodiment of a backbone 302.
Figure 3C:
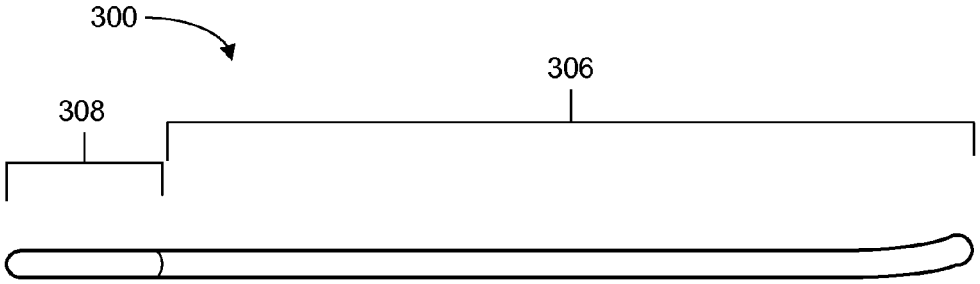
FIG. 3C depicts a side view of an embodiment of the backbone 302 of FIG. 3B.

FIGS. 3A-3E depict embodiments of a lateral flex sports board 300. FIG. 3A depicts a cut-away top view of one embodiment of a sports board 300 that allows for a lateral flex. Within the sports board 300, the elongated load supporting board 302 includes a backbone 304 (an elongated structure that is typically a centrally located and internal structure). The backbone 304 is shaped to allow for a lateral flex. As is shown in FIGS. 3B-3C, the backbone 304 comprises a lateral flex portion 306 and a tail portion 308. The flex portion 306 allows for lateral flex. The tail portion 308, which is not necessary, may allow for the securing of a fin, a component of a finished water ski. As depicted the tail portion 308 may include a void 310 that allows for a fin and fin box to be secured. FIG. 3B depicts a top view of an embodiment of the backbone 304 outside of the load supporting board 302. FIG. 3C depicts a side view of an embodiment of the backbone 304 of FIG. 3B outside of the load supporting board 302.

Figure 3D:
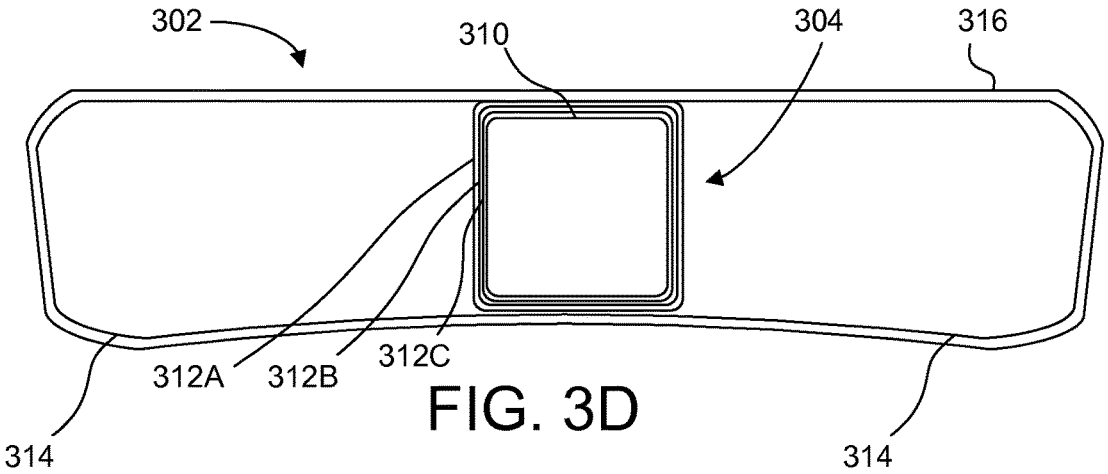
FIG. 3D shows a cut-away cross-sectional view of the backbone 302 within the sports board 300.

FIG. 3D shows a cut-away cross-sectional view of the elongated load supporting board 302 including the backbone 304. The flex portion 306 of the backbone 304 may be constructed or formed into various shapes to allow for lateral flex of the backbone 304 and thus the load supporting board 302. In the illustrated embodiment, the backbone 304 comprises a backbone core 310 surrounded by fiber layers 312A-312C. The thickness of the fiber layers 312A-312C are shown exaggerated for clarity. The number, thickness, orientation, and material of the fiber layers 312A-312C may vary. The fiber layers 312A-312C are depicted as wrapped around the backbone core 310. However, embodiments may include a different number of layers on the top, bottom, or sides of the backbone core 310, respectively.

The cross-section of the flex portion 306 of the backbone 304 depicts a cross-section for the backbone 304 that allows a lateral flex in contrast to the cross section of the board 106 shown in FIG. 1D. The core of the board 106 shown in FIG. 1D will not allow a lateral flex as the width (the horizontal dimension) of the core is greater than the thickness (the vertical dimension) of the core. In the illustrated embodiments of FIGS. 3A-3E, the width (the horizontal dimension) of the flex portion 306 of the backbone 304 is depicted to be approximately equal to the thickness (the vertical dimension) of the flex portion 306 of the backbone 304. In some embodiments, the width of the flex portion 306 of the backbone 304 is greater than the thickness of the flex portion 306 of the backbone 304. In some embodiments, the width of the flex portion 306 of the backbone 304 is less than the thickness of the flex portion 306 of the backbone 304. In FIG. 3D, the backbone 304 is depicted within the board overlapping layer 316. Also depicted is the board core 314. In some embodiments, the board core 314 may be a flexible material that allows for an overall lateral flex of the sports board. In some embodiments, the board core 314 is a rigid material with voids or slots (shown and described in more detail in other embodiments). The board overlapping layer 316 may provide a seal to protect the board core 314 and the backbone 304 from exposure to water or other potentially damaging substances. The board overlapping layer 316 may include multiple layers including fiber layers similar to fiber layers 312A-312C and a sealing layer. In some embodiments, the overlapping layer 316 may only include a sealing layer. The number, thickness, orientation, and material of any overlapping fiber layers and sealing layer may vary.

Figure 3E:
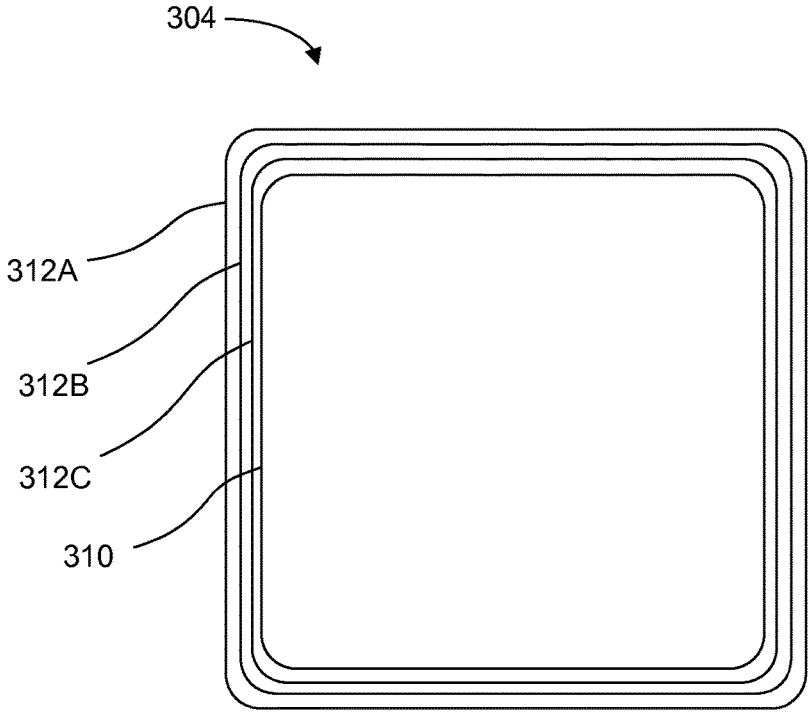
FIG. 3E depicts a cut-away cross-sectional view of the backbone 302 with a backbone core 308 surrounded by the fiber layers 310A-310C.

FIG. 3E depicts a cut-away cross-sectional view of just the backbone 304 with a backbone core 310 surrounded by the fiber layers 312A-312C. The depicted cross section of the backbone core 308 is rectangular with rounded corners but may be elliptical, square, or another shape that allows for flexing laterally. The shape depicted allows for longitudinal flex as well as lateral flex.

Figure 4A:
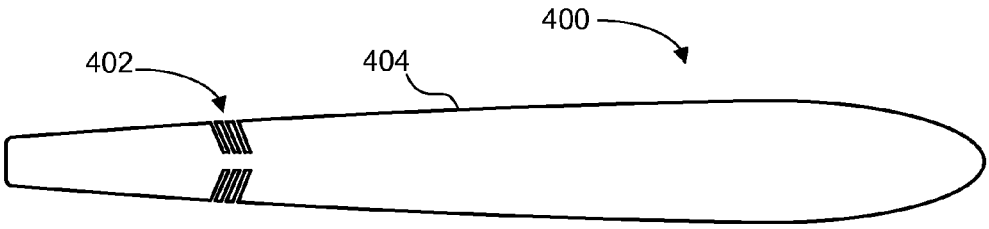
FIGS. 4A-4C depict a top view of a sports board 400 with slots 402 in the sports board 400.
Figure 4B:
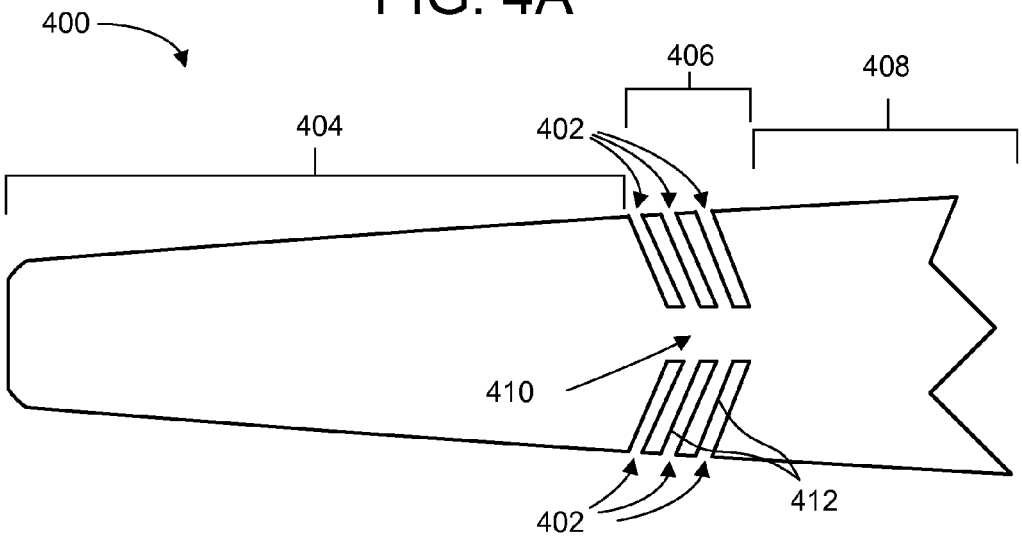
Figure 4C:
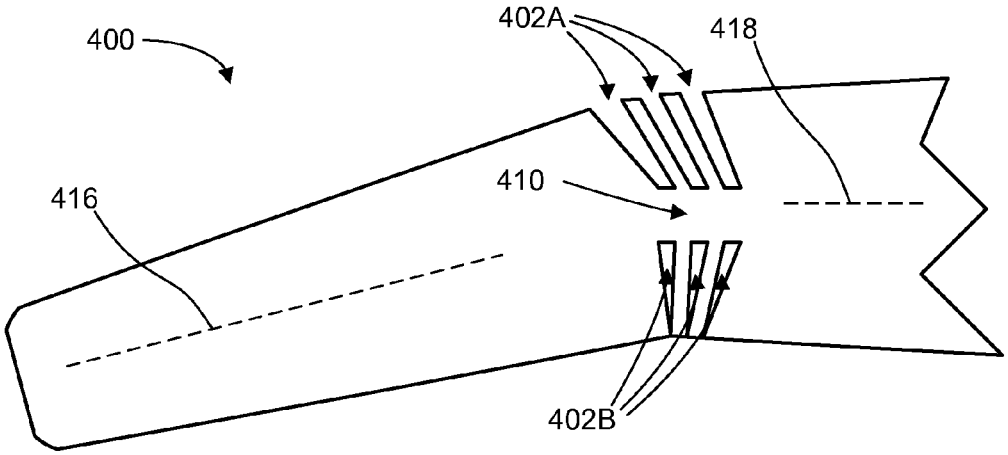

FIGS. 4A-4C depict a top view of a sports board 400 with slots 402 in the sports board 400. Some embodiments include slots 402 on the elongated load supporting board 414. The slots 402 allow for the localization of the lateral flex on a specific portion of the sports board 400. As the natural shape of a sports board restricts a lateral flex, FIGS. 4A-4C depict how the implementation of slots 402 or kerfs or voids etc. allow the sports board to flex laterally. FIG. 4B depicts an enlarged view of the rear of the sports board 400 and slots 402. FIG. 4B also depicts a tail portion 404 and a foothold support portion 408 with a flexing portion 406 located between the tail portion 404 and the foothold support portion 408. The flexing portion 406 includes the slots 402 and a lateral flexing spine 410 which connects the foothold support portion 408 with the tail portion 404.

FIG. 4C depicts the sports board 400 in a lateral flex position with tail portion 404 of the sports board 400 laterally flexed in relation to the foothold support portion 408 of the sports board 400. Shown in exaggerated form, the axis (depicted by dashed line 416) of the tail portion 404 is no longer aligned with the axis (depicted by dashed line 418) of the foothold support portion 408. The narrowness of the spine 410 allows for the sports board 400 to flex laterally in the flexing portion 406. The slots 402A on one side of the sports board 400 are depicted as expanded. That is, the distance between the ribs 412 has increased. The slots 402B on the opposite side of the sports board 400 are depicted as compressed. That is, the distance between the ribs 412 has decreased. The slots 402 allow for the sports board to flex laterally in the flexing portion 406 of the sports board 400 as the cross section of the spine 410 allows the lateral flex. The slots 402 also allow for the remainder of the board core to be made of a rigid material.

The slots 402 depicted in FIGS. 4A-4C are voids extending from the top major surface (visible in the top view) of the sports board 400 to the bottom major surface (not visible) of the sports board 400. The slots 402 are depicted as extending from the spine 410 to the side edges of the sports board 400. In some embodiments, the slots 402 do not extend all the way from the top major surface to the bottom major surface but only extend a portion. In some embodiments, the slots 402 are internal to the sports board 400. For example, the slots 402 may be slots only in a board core. The slots may then be covered by fiber layers or overall overlapping layer such as is depicted in FIG. 3D. In some embodiments, instead of a void between ribs 412, a flexible material may occupy the space between the ribs 412. The flexible material may allow for the compression and expansion that is shown in slots of FIG. 4C.

In the depicted embodiment, the slots 402 are shaped as parallelograms but may be of different shapes such as a wedge, rectangle, trapezoid, or thin parallel kerfs. While the depicted embodiment includes three slots on each side of the spine 410, the number of slots may vary. The slots 402 depicted are angled towards the rear of the sports board 400 but in some embodiments may be angled away from the rear or may be perpendicular to the spine 410. The size, shape, number, and angle of the slots 402 may vary. In some embodiments, the slots 402 are approximately 0.050 inches thick when cut. In some embodiment, the slots are approximately between 0.005 inches thick and 0.500 inches thick. The number and thickness of the slots affect the amount of lateral flex of the sports board 400. For example, three slots approximately 0.050 inches thick will allow more lateral flex than one slot approximately 0.010 inches thick. In embodiments with a rigid board core, the board would only flex laterally enough to close the gaps of the slots 402. Therefore, the amount of lateral flex could be controlled for each individual board depending on the number and thickness of the slots 402 manufactured. In some embodiments, the slots are cut through fiber layers and a board core. In some embodiments, the board core is exposed after the slots are cut.

In some embodiments, the slots 402 are located directly in front of the fin and/or fin box. In some embodiments, the slots 402 are located between the foothold portion 408 of the board 400 and the fin box. In some embodiments, the slots 402 are located between two separate foothold positions. For example, with water skis, a user would have one foot in front of the other on the board. The slots 402 may be located between where the two feet would be positioned on the water ski. In some embodiments, the slots 402 may be located in more than one position. For example, slots 402 may be located between the foothold portion 408 and the tail portion 404 where the fin box and fin are located as well as between where the two feed of a user would be positioned on the board 400.

Figure 5:
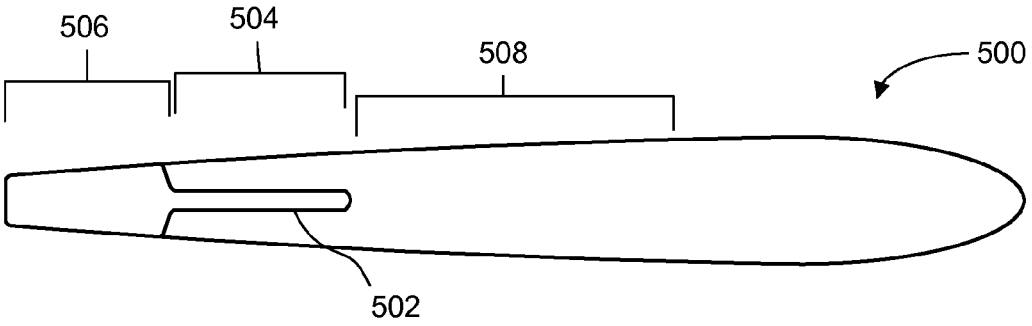
FIG. 5 depicts an embodiment of a lateral flex sports board 500 with a short backbone 502.

FIG. 5 depicts a top view of a cut-away of an embodiment of a lateral flex sports board 500 with a short backbone 502. The backbone 502 includes a flexing portion 504 and a tail portion 506. The backbone 502, while shown, is internal to the sports board 500. The length of a backbone 502 may vary in embodiments and does not need to extend the length of the sports board. In some embodiments, the backbone 502 extends the length of the sports board 500 from the front to the rear of the sports board 500. In the illustrated embodiment, the backbone 502 only extends a portion of the length of the sports board 500. In some embodiments, the backbone 502 may extend from a foothold support portion 508 of the sports board to the rear of the sports board 500.

Figure 6:
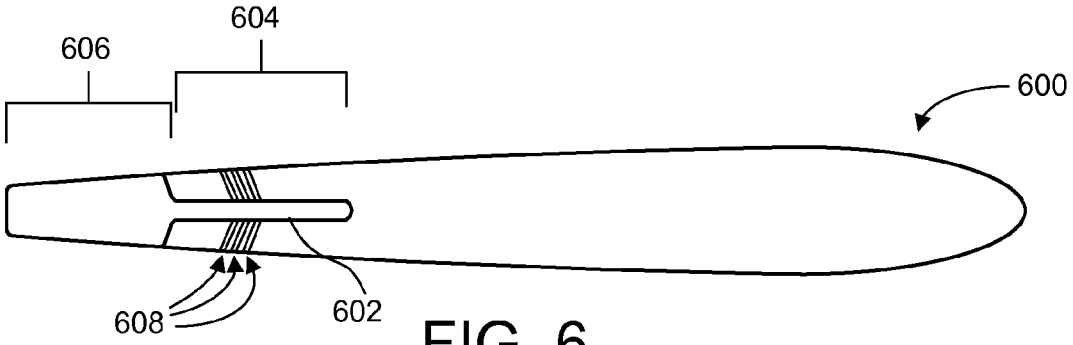
FIG. 6 depicts an embodiment of a lateral flex sports board 600 including a short backbone 602 along with slots 608.

FIG. 6 depicts a top view of a cut-away of an embodiment of a lateral flex sports board 600 including a short backbone 602 along with slots 608. While the backbone 602, including the flexing portion 604 and the tail portion 606, is shown, the backbone 602 is internal to the lateral flex sports board 600 and may be covered by an outer layer such as an acrylic coating. The slots 608 may be similar to the slots described in conjunction with FIGS. 4A-4C. In the illustrated embodiment, the slots 608 may extend from the backbone 602 to the sides of the lateral flex sports board 600 and may extend from the top major surface to the bottom major surface of the sports board 600. In some embodiments, the slots may be internal to an outer layer or coating. In some embodiments, the slots are filled with a flexible material able to compress and expand during a lateral flex movement of the sports board.

Figure 7:
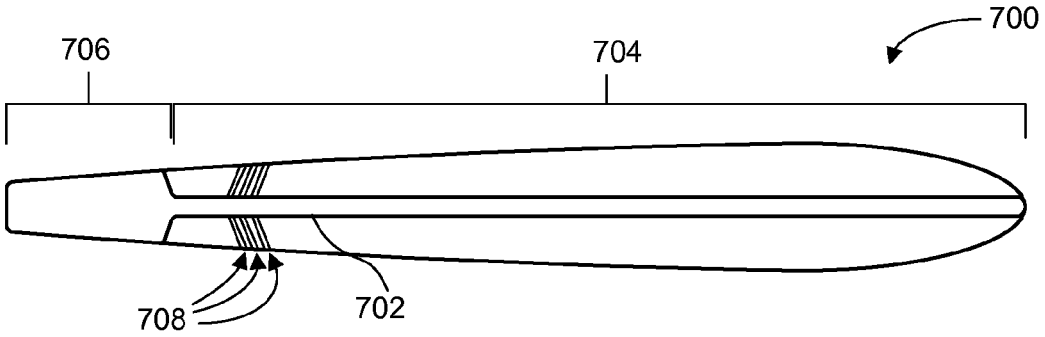
FIG. 7 depicts an embodiment of a lateral flex sports board 700 including a full length backbone 702 along with forward angled slots 708.

FIG. 7 depicts an embodiment of a lateral flex sports board 700 including a full length backbone 702 along with forward angled slots 708. While the backbone 702, including the flexing portion 704 and the tail portion 706, is shown, the backbone 702 is internal to the lateral flex sports board 700 and may be covered by an outer layer such as an acrylic coating. The slots may be similar to the slots described in conjunction with FIGS. 4A-4C. In the illustrated embodiment, the slots 708 may extend from the backbone 702 to the sides of the lateral flex sports board 700 and may extend from the top major surface to the bottom major surface of the sports board 700. In some embodiments, the slots may be internal to an outer layer or coating. In such embodiments, the slots extend from the backbone 702 to the outer layer or coating and from the outer layer or coating on the top major surface and the outer layer or coating on the bottom major surface. The outer layer or coating may include fiber layers as well as a sealed coating layer. In some embodiments, the slots 708 are filled with a flexible material able to compress and expand during a lateral flex movement of the sports board.

Figure 8:
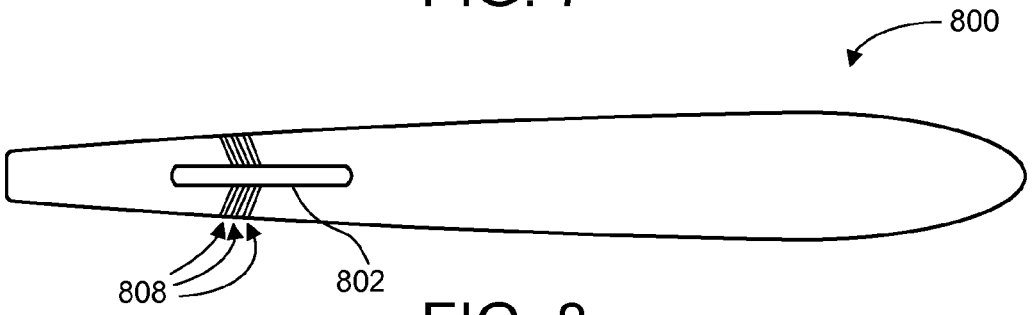
FIG. 8 depicts an embodiment of a lateral flex sports board 800 including a short backbone 802 along with slots 808.

FIG. 8 depicts an embodiment of a lateral flex sports board 800 including a short backbone 802 along with slots 808. While the backbone 802 is shown, the backbone 802 is internal to the lateral flex sports board 800 and may be covered by an outer layer such as an acrylic coating. The backbone 802 only includes a flexing portion 804 without a tail portion. The slots 808 may be similar to the slots described in conjunction with FIGS. 4A-4C. In the illustrated embodiment, the slots 808 may extend from the backbone 802 to the sides of the lateral flex sports board 800 and may extend from the top major surface to the bottom major surface of the sports board 800. In some embodiments, the slots may be internal to an outer layer or coating. In some embodiments, the slots are filled with a flexible material able to compress and expand during a lateral flex movement of the sports board.

Figure 9A:
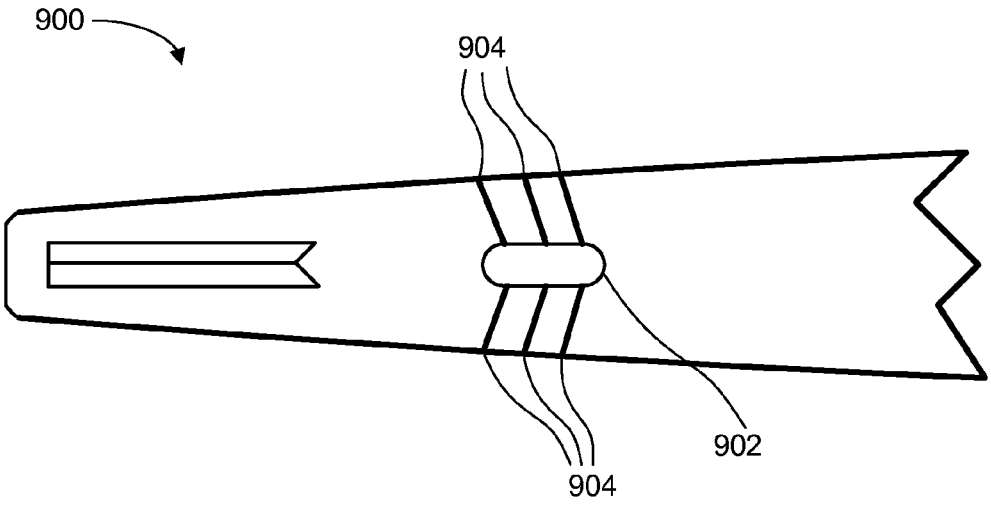
FIGS. 9A-9B depict an embodiment of a sports board 900 including a vertical knob 902.
Figure 9B:
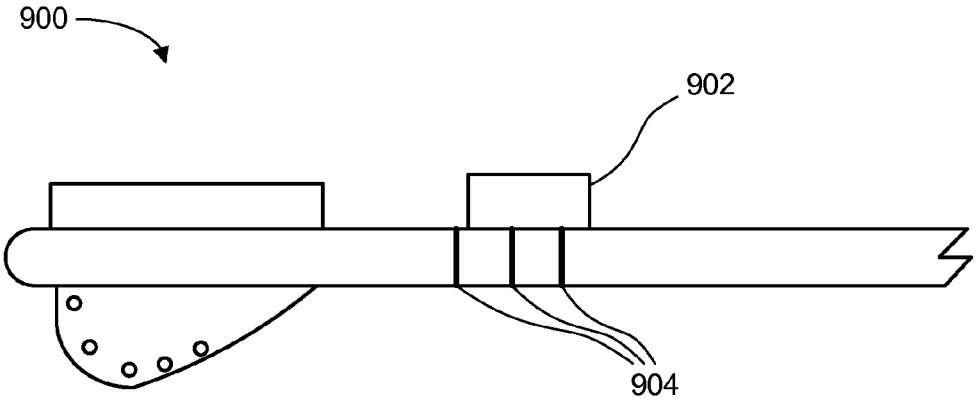

Some embodiments described herein include slots on a portion of a sports board. Such slots which may extend all the way through the sports board or a portion of the sports board may result in a structural weak spot on a spine or backbone between the slots. Such a spine or backbone may be subject to forces that would result in breaking the sports board. For example, the sports board may be subject to forces that cause a longitudinal flex (as described above) which could potentially result in a fracture or other failure at the spine. FIGS. 9A-9B depict an embodiment of a sports board 900 including a vertical knob 902. The vertical knob 902 extends vertically from the sports board 900 at a location of the spine of the sports board. The slots or kerfs 904 extend from spine to the sides of the sports board 900. The raised knob 902 extends the profile of the spine in the vertical direction. The increased profile strengthens the flexing portion of sports board and will resist forces that cause a longitudinal flex. FIG. 9B shows a side view of the embodiment depicted in FIG. 9A. As depicted, the raised knob 902 extends vertically from the primarily flat top major surface of the sports board. The shape and height of the raised knob 902 may vary.

Figure 10A:
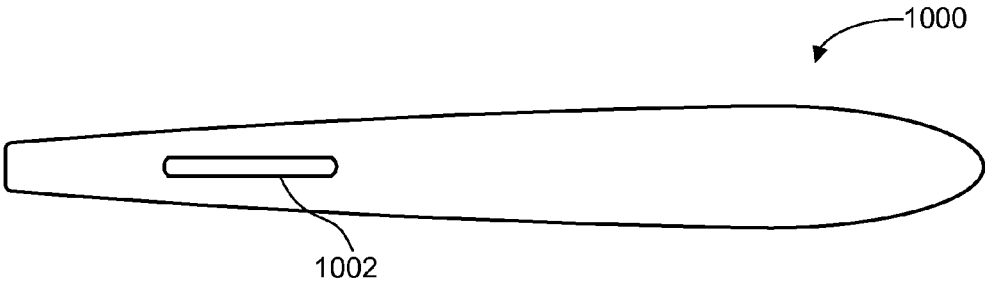
FIG. 10A depicts a top view of one embodiment of a board core.
Figure 10B:
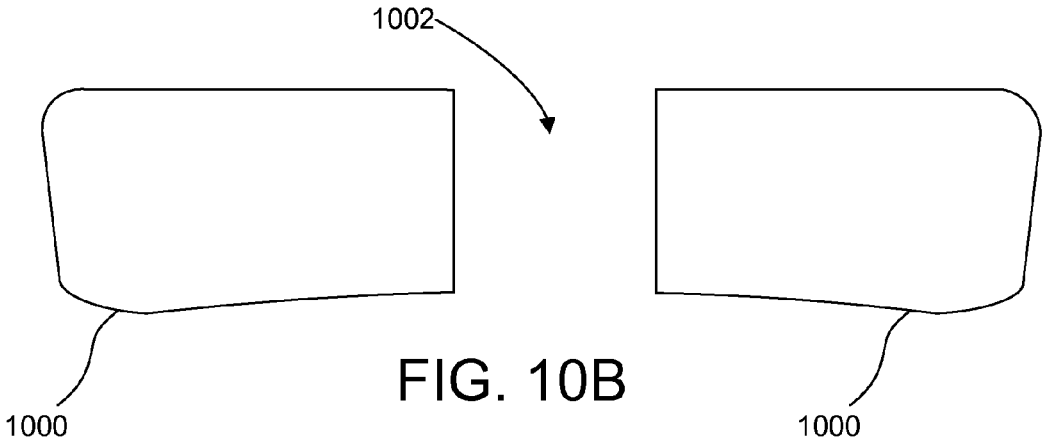
FIG. 10B depicts a cut-away cross-sectional view of the board core at the cavity.
Figure 10C:
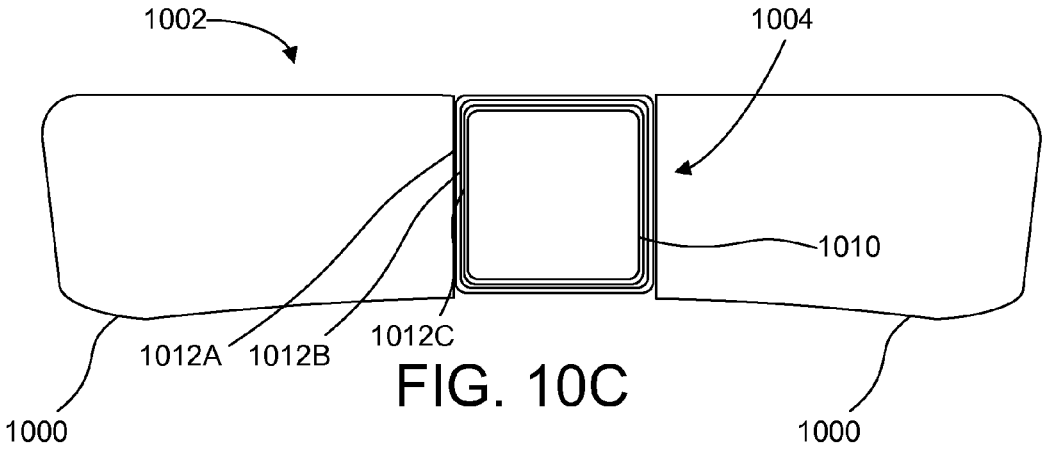
FIG. 10C depicts a cut-away cross-sectional view of the board core with a backbone inserted into the cavity.
Figure 10D:
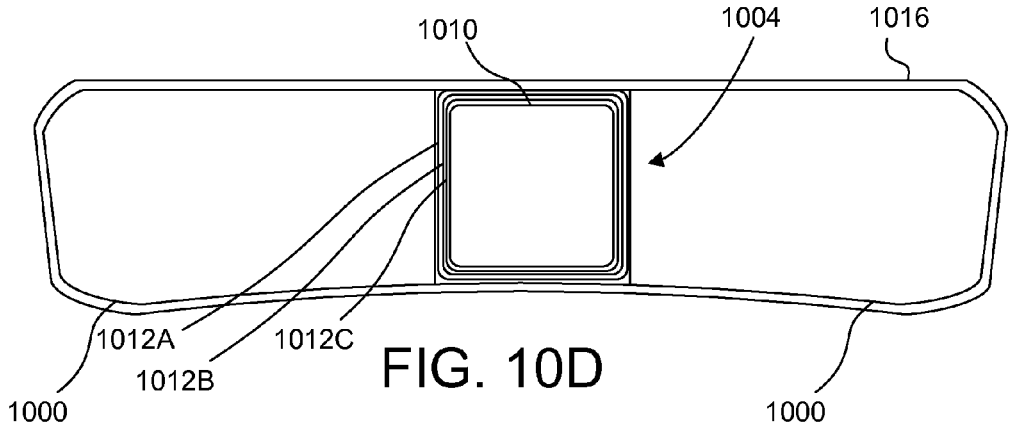
FIG. 10D depicts a cut-away cross-sectional view of the board core with a backbone inserted into the cavity and an overlapping layer that covers the board core and the backbone.

FIG. 10A depicts a top view of one embodiment of a board core 1000. In some embodiments, the board core 1000 is manufactured of a rigid material. The board core 1000 is manufactured to the essential shape of a finished board. In some embodiments, a cavity 1002 is removed from the board core 1000. The cavity 1002 is the approximate size of a backbone. In the illustrated embodiment the cavity 1002 is the approximate size of a short backbone (shown in FIG. 8). In some embodiments the cavity 1002 runs the length of the board core. The cavity 1002 may be of varying size. In some embodiments, the board core 1000 is manufactured with the cavity 1002. In some embodiments the cavity 1002 is made by removing material after manufacturing the cavity 1002. FIG. 10B depicts a cut-away cross-sectional view of the board core at the cavity 1002. FIG. 10C depicts a cut-away cross-sectional view of the board core 1000 with a backbone 1004 inserted into the cavity 1002. The backbone 1004 may include a core 1010 with fiber layers 1012A-1012C. In some embodiments, the fiber layers 1012A-1012C are cured when the backbone 1004 is placed into the cavity. In some embodiment, the fiber layers 1012A-1012C are cured along with the overlapping layer (shown in FIG. 10D). FIG. 10D depicts a cut-away cross-sectional view of the board core 1000 with a backbone 1004 inserted into the cavity 1002 and an overlapping layer 1016 (which may comprise a varying number, size, orientation of fiber layers) that covers the board core 1000 and the backbone 1004. In some embodiments, the overlapping layer(s) 1016 are cured with the fiber layers 1012 of the backbone. The thickness of the fiber layers 1012A-1012C are shown exaggerated for clarity. The number, thickness, orientation, and material of the fiber layers 1012A-1012C may vary. The fiber layers 1012A-1012C are depicted as wrapped around the backbone core 1010. However, embodiments may include a different number of layers on the top, bottom, or sides of the backbone core 1010, respectively.

In some embodiments, after the fiber layers 1012 and overlapping layer 1016 are cured, slot(s) (described and depicted in other embodiments herein) are cut into the board. In some embodiments, slot(s) are cut all the way through the board core 1000. In some embodiments, the slot(s) are cut through the overlapping layer(s) 1016 and board core 1000 all the way to the backbone 1004. In some embodiments, the slots are cut on each side of the backbone 1004. In some embodiments, the slots are cut from the side of the board only a portion of the way to the backbone, leaving a portion of the backbone 1000 uncut. Some embodiments do not include a cavity 1002 or backbone 1004. In such embodiments, slots are cut in the board core 1000 on each side of a board. The portion of the board core 1000 between the slots would be a spine (shown and described somewhat in conjunction with FIGS. 4A-4C. Such a spine would function like the backbone of the illustrated embodiment of FIG. 10D. In some embodiments, the spine of the sports board is a separate backbone. In some embodiments, the spine is part of the board core 1000.

Figure 11:
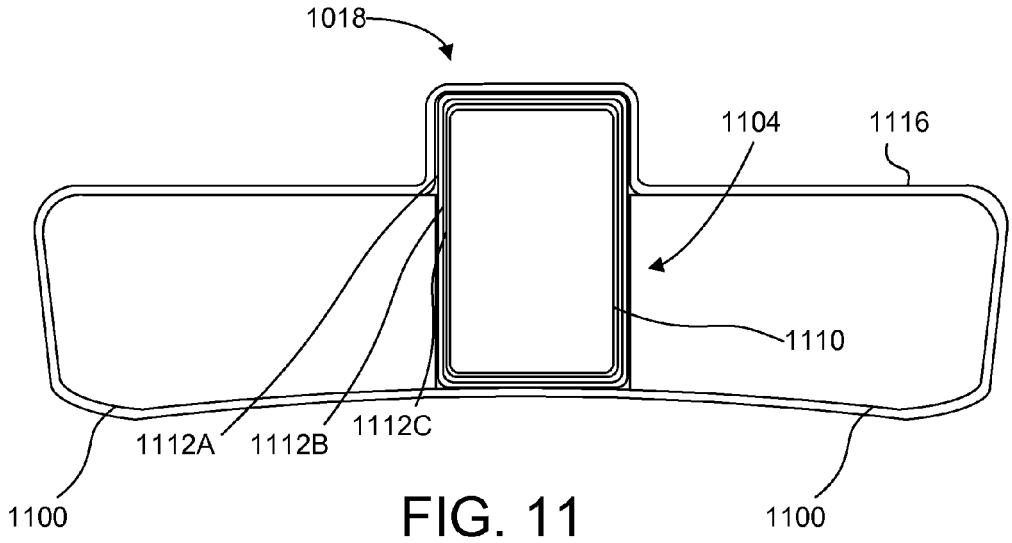
FIG. 11 depicts a cut-away cross-sectional view of the board core with a backbone inserted into the cavity and an overlapping layer.

FIG. 11 depicts a cut-away cross-sectional view of the board core 1100 with a backbone 1104 inserted into the cavity 1002 and an overlapping layer 1116. The illustrated embodiment is similar the embodiment depicted in FIG. 10D, however, the backbone extends above the board core 1000. In the illustrated embodiment, the extended backbone 1104 will create a vertical knob 1018 similar to what is described in conjunction with FIG. 9. In the illustrated embodiment, the backbone and vertical knob are from the same core 1110 and fiber layers 1112A-1112C. The thickness of the fiber layers 1112A-1112C are shown exaggerated for clarity. The number, thickness, orientation, and material of the fiber layers 1112A-1112C may vary. The fiber layers 1112A-1112C are depicted as wrapped around the backbone core 1110. However, embodiments may include a different number of layers on the top, bottom, or sides of the backbone core 1110, respectively.

The cross-section of the backbone 1104 allows a lateral flex in contrast to the cross section of the board 106 shown in FIG. 1D. The core of the board 106 shown in FIG. 1D will not allow a lateral flex as the width (the horizontal dimension) of the core is greater than the thickness (the vertical dimension) of the core. In the illustrated embodiment, the width (the horizontal dimension) of the backbone 1104 is depicted to be less than the thickness of the backbone 1104. In some embodiments, the width of the backbone 1104 is approximately equal to the thickness (the vertical dimension) of the backbone 1104. In some embodiments, the width of the backbone 1104 is greater than the thickness of the backbone 1104.

In some embodiments, the board core 1100 may be a flexible material that allows for an overall lateral flex of the sports board. In some embodiments, the board core 1100 is a rigid material with voids or slots (shown and described in more detail in other embodiments). The board overlapping layer 1116 may provide a seal to protect the board core 1000 and the backbone 1104 from exposure to water or other potentially damaging substances. In some embodiments, the backbone 1104 and board core 1000 are exposed when slot(s) are cut.

Figure 12:
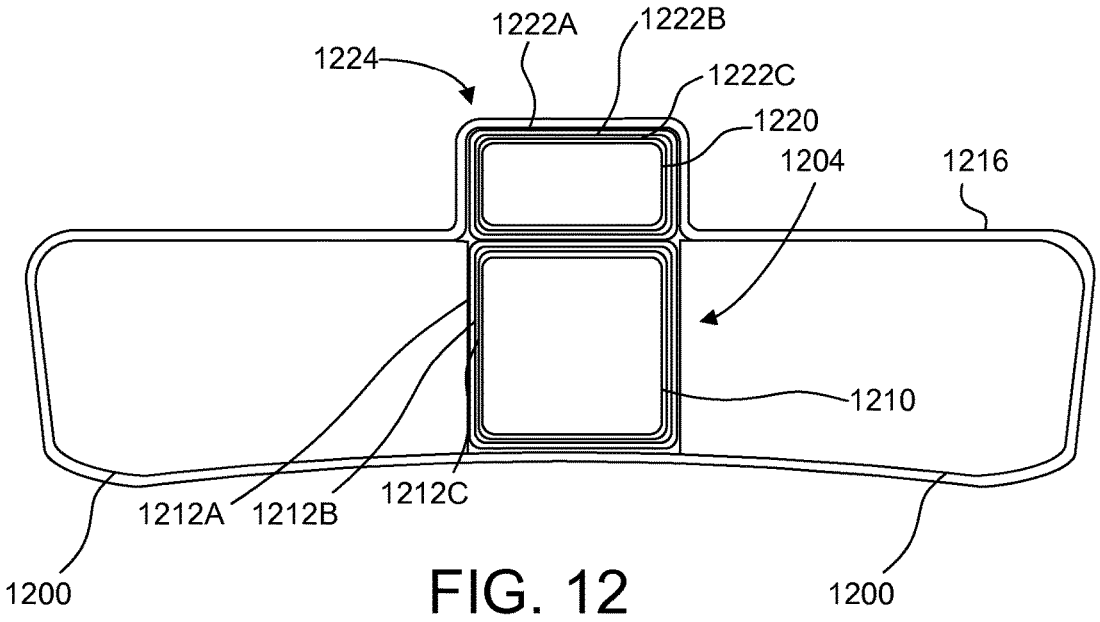
FIG. 12 depicts a cut-away cross-sectional view of the board core with a backbone inserted into a cavity and an overlapping layer.

FIG. 12 depicts a cut-away cross-sectional view of the board core 1200 with a backbone 1204 inserted into a cavity and an overlapping layer 1216. The illustrated embodiment is similar the embodiment depicted in FIG. 11, however, the backbone 1204 and the vertical knob 1224 are separate. The backbone 1204 is similar to what is shown and described in conjunction with FIG. 10D. The vertical knob 1224 includes a separate core 1220 and separate fiber layers 1222A-1222C. The thickness of the fiber layers 1212A-1212C and 1222A-1222C are shown exaggerated for clarity. The number, thickness, orientation, and material of the fiber layers 1112A-1112C and 1222A-1222C may vary. The fiber layers 1212A-1212C are depicted as wrapped around the backbone core 1210. However, embodiments may include a different number of layers on the top, bottom, or sides of the backbone core 1210, respectively. In some embodiments the vertical knob core 1220 is not wrapped in fiber layers 1222A-1222C. In such embodiments, the vertical knob core 1220 is merely wrapped in the overlapping layer 1216 similar to the board core 1200. In some embodiments, the vertical knob 1224 is attached to the backbone 1204. In some embodiments, the vertical knob 1224 is not attached to the backbone 1204. In some embodiments, the vertical knob 1224 only extends a portion of the length of the backbone 1204. For example, the backbone 1204 may run along the length of the board and the vertical knob 1224 will only run along a small portion of the backbone 1204.

Some embodiments may not include a separate backbone 1204. In such embodiments the board core 1200 would not have a cavity but be one solid piece (similar to what is shown and described in conjunction with FIGS. 4A-4C). In such embodiments, the vertical knob 1224 may be attached or placed on the board core 1200 and an overlapping layer 1216 would cover the board core and the vertical knob 1224. Such embodiments may or may not include the fiber layers 1222A-1222C. In such embodiments, slots would be cut in the board core 1200. In some embodiments, the slots would extend to the vertical knob (as can be seen in FIG. 9A). In some embodiments, the resulting cross section of the board core 1200 at the slots would be shaped similar to the cross section of the backbone 1204 shown in FIG. 12. The cross section of the board core 1200 at the slots would function as a spine of the board core 1200 and be shaped to allow for lateral flex of the sports board.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

Although various embodiments have been shown and described, the present disclosure is not so limited and will be understood to include all such modifications and variations are would be apparent to one skilled in the art.

What is claimed is:

1. A lateral flex sports board comprising:

an elongated load supporting board having a top surface, wherein the elongated load supporting board comprises a lateral flex portion, wherein the lateral flex portion flexes laterally within a plane of the top surface, and wherein the elongated load supporting board further comprises a backbone, wherein the backbone comprises the lateral flex portion, wherein the elongated load supporting board further comprises at least one slot on each side of the lateral flex portion.

2. The lateral flex sports board of claim 1, wherein a thickness of the lateral flex portion of the backbone is greater than a width of the lateral flex portion of the backbone.

3. The lateral flex sports board of claim 1, wherein a thickness of the lateral flex portion of the backbone is less than a width of the lateral flex portion of the backbone.

4. The lateral flex sports board of claim 1, wherein a thickness of the lateral flex portion of the backbone is equal to a width of the lateral flex portion of the backbone.

5. The lateral flex sports board of claim 1, wherein the backbone comprises a core and fiber layers surrounding the core.

6. The lateral flex sports board of claim 1, wherein the at least one slot on each side of the lateral flex portion of the backbone extends from the top surface to a bottom surface of the load supporting board.

7. The lateral flex sports board of claim 6, wherein the at least one slot on each side of the lateral flex portion of the backbone extends from the backbone to side edges of the load supporting board.

8. The lateral flex sports board of claim 1, wherein the elongated load supporting board further comprises a fin and a support portion, and wherein the lateral flex portion is located between the support portion and the fin.

9. The lateral flex sports board of claim 8, wherein the elongated load supporting board further comprises a slot in the lateral flex portion of the load supporting board.

10. The lateral flex sports board of claim 9, wherein the elongated load supporting board further comprises a vertical knob extending from the lateral flex portion of the load supporting board.

11. The lateral flex sports board of claim 9, wherein the slot extends from the top surface to a bottom surface of the load supporting board and wherein the slot extends from a side edge less than half a width of the load supporting board.

12. The lateral flex sports board of claim 1, wherein the top surface is configured to support a standing user.

13. The lateral flex sports board of claim 1, wherein the lateral flex sports board is a water sports board.

14. The lateral flex sports board of claim 1, wherein the elongated load supporting board is a water ski, wherein the elongated load supporting board further comprises a fin and a support portion, wherein the support portion is configured to support the user and wherein the lateral flex portion is located between the support portion and the fin.

15. The lateral flex sports board of claim 1, further comprising a flexible material within the at least one slot on each side of the lateral flex portion.

16. A lateral flex sports board comprising:

a board core wrapped in an overlapping layer, wherein the board core comprises a top surface and a bottom surface;

a lateral flexing spine positioned within the overlapping layer, wherein the lateral flexing spine flexes laterally within a plane of the top surface;

wherein the board core further comprises slots extending from the top surface to the bottom surface on each side of the lateral flexing spine.

17. The lateral flex sports board of claim 16, wherein the spine is a backbone separate from the board core.

18. The lateral flex sports board of claim 16, wherein the spine is part of the board core.

19. The lateral flex sports board of claim 16, further comprising a flexible material within the slots.

* * * * *